United States Patent [19]

Anderson

[11] Patent Number: 4,574,222

[45] Date of Patent: Mar. 4, 1986

[54] BALLAST CIRCUIT FOR MULTIPLE PARALLEL NEGATIVE IMPEDANCE LOADS

[75] Inventor: Thomas E. Anderson, Avon, Conn.

[73] Assignee: General Electric Company, Schenectady, N.Y.

[21] Appl. No.: 565,319

[22] Filed: Dec. 27, 1983

[51] Int. Cl.[4] ..... H05B 41/16; H05B 41/24

[52] U.S. Cl. ..... 315/254; 315/257; 315/277; 315/278; 336/173

[58] Field of Search ..... 315/178, 181, 254, 255, 315/257, 277, 278, 279; 336/173, 174

[56] References Cited

U.S. PATENT DOCUMENTS 2,392,845 1/1946 Foerste ..... 315/279
2,429,162 10/1947 Keiser et al. ..... 315/278 X
4,388,562 6/1983 Josephson ..... 315/178

FOREIGN PATENT DOCUMENTS 0611810 11/1948 United Kingdom ..... 315/278

*Primary Examiner*—Saxfield Chatmon
*Attorney, Agent, or Firm*—N. D. Herkamp; Philip L. Schlamp; Fred Jacob

[57] ABSTRACT

A current-balancing transformer is provided to supply plural parallel-connected electrical loads, especially loads such as gas discharge lamps which exhibit negative impedance and/or non-linear impedance over at least a part of their normal operating range. The current-balancing transformer forces current sharing among the loads so that each of the parallel-connected loads is supplied operating current.

12 Claims, 3 Drawing Figures

BALLAST CIRCUIT FOR MULTIPLE PARALLEL NEGATIVE IMPEDANCE LOADS

BACKGROUND OF THE INVENTION

1. Field of the Invention

This invention relates to power supply circuits for multiple parallel electrical loads and, more particularly, to a ballast circuit having a current-balancing transformer for supplying electrical power to multiple parallel negative and/or non-linear impedance loads, such as gas discharge lamps.

2. Description of the Prior Art

A gas discharge lamp, e.g., a fluorescent lamp, is an electrical device which exhibits certain special electrical characteristics; among them, a negative impedance characteristic, which means that once the arc has been struck, increased current through the discharge medium within the lamp results in decreased voltage drop between the lamp electrodes; a positive impedance characteristic, which means that during normal operation at high frequency (frequencies greater than approximately 300 Hz) the lamp appears essentially as a resistive device throughout the high frequency cycle; and a non-linear impedance, which means that during the application of low frequency voltage the impedance changes during the cycle. A fluorescent lamp powered from a high frequency inverter (say 20 kHz) operated from an unfiltered rectified 60 Hz source exhibits all three impedance characteristics simultaneously. Because of these characteristics, it is necessary to provide means for current limitation in the ballast circuit. If current limitation means are not provided, lamp failure or ballast burnout generally results. An efficient fluorescent lamp ballast can be inductive, capacitive or dynamically controlled by a high frequency inverter. The most typical fluorescent ballast is an inductor which exhibits an inductive impedance. Additionally, because of the negative impedance characteristic, parallel operation of gas discharge lamps is generally precluded even though it provides certain desirable features, because one lamp will divert all the current. Furthermore, when parallel operation is attempted, the arc in one lamp is generally struck first, and this eventually carries all of the current supplied to the parallel lamp combination preventing starting of other lamps. Thus, conventional parallel operation results in only one lamp of a parallel-connected set being started. All the rest stay dark. Clearly, such a mode of operation is not tolerable. Accordingly, series operation of gas discharge lamps has been considered to be the only viable mode of operation. However, series operation of gas discharge lamps operated at high frequency (20 kilohertz and above) may produce the undesirable result of capacitively coupled leakage currents through the glass lamp envelope. This phenomenon is more significant in series-connected lamps, because larger voltage drops can occur along the lamp string than along a single lamp or parallel combination of lamps. Ballast circuit designs also incorporate a means for lamp starting. Therefore, it should be appreciated that the discussion above, and herein generally, relates to both starting lamps and driving lamps which have already been started.

Further discussion of lamp ballast circuit requirements is recited in U.S. patent application Ser. No. 292,324 filed by Victor David Roberts on Aug. 12, 1981, and assigned to the present assignee, now abandoned. In the above-identified patent application, a solution is presented to the current-sharing problem for more than two parallel negative and/or non-linear impedance loads by supplying power to each of a plurality of parallel discharge lamps from separate windings wrapped upon separate core legs of a multi-legged supply transformer. Power is supplied to a primary winding wrapped upon a first leg of the transformer core, and identical windings wrapped upon parallel secondary core legs provide output to each of the plurality of parallel discharge lamps. This construction provides flux sharing within the transformer core between the secondary core legs with full volt-second core requirements on each secondary leg. Therefore, the lamp loads are effectively connected in series with each other.

In FIG. 1, a prior art ballast circuit configuration is shown in which two parallel gas discharge lamps 38, 40 are connected to separate coils 26, 28 wound upon a magnetic core 24. A single main ballast inductor 20 is used to supply current to windings disposed upon the core. This configuration will tolerate only small lamp-to-lamp voltage differences and is not readily extended to a ballast circuit for driving more than two lamps due to the fact that a third winding placed upon the core 24 would result in an unequal flux sharing, since in order for the fluxes to balance, one winding must be creating flux which opposes the flux generated by the other two windings. In order to provide flexibility and practicality in the design of gas discharge lamp systems, a ballast circuit for driving more than two parallel-connected lamps is required.

SUMMARY OF THE INVENTION

A primary objective of the present invention is to provide a ballast and current-sharing circuit for powering parallel-connected gas discharge lamps.

Another object of the present invention is to provide a ballast circuit for starting more than two gas discharge lamps connected in a parallel configuration.

In accordance with a preferred embodiment of the present invention, a ballast circuit for driving a plurality of three or more gas discharge lamps comprises a multi-legged current-balancing transformer core having at least three legs, with a winding disposed about each of the transformer legs, a gas discharge lamp connected in series with each of said windings, with one end of a filament of each of said parallel discharge lamps being connected to the other side of a power supply.

BRIEF DESCRIPTION OF THE DRAWINGS

Further objects and advantages of the present invention together with its organization, method of operation and best mode contemplated may best be understood by reference to the following description taken in conjunction with the accompanying drawings, in which like reference characters refer to like elements throughout, and, in which.

DESCRIPTION OF THE PREFERRED EMBODIMENTS

Figure 1:
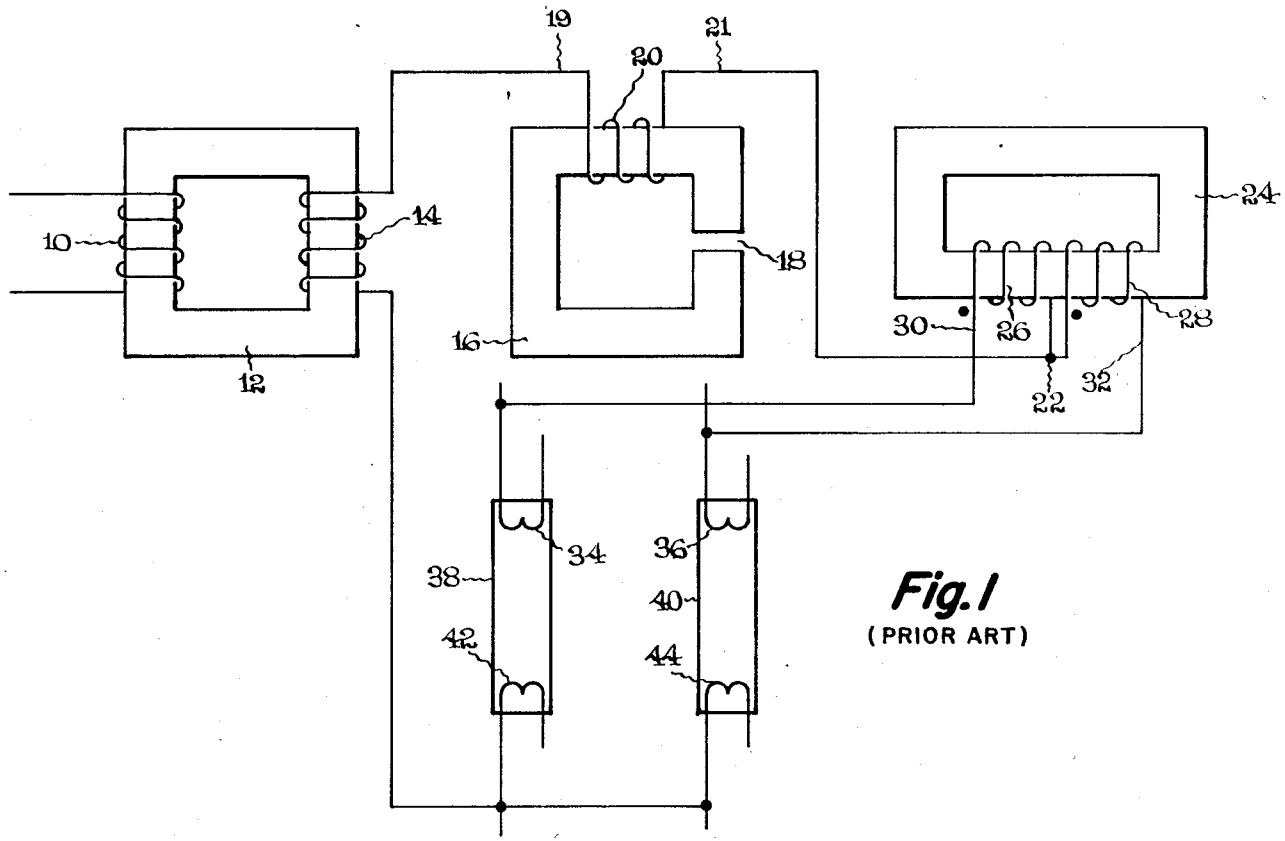
Fig. 1 (PRIOR ART)
FIG. 1 is a circuit diagram illustrating a prior art parallel lamp ballast circuit.

FIG. 1 illustrates a prior art gas discharge lamp ballast circuit showing two lamps connected in parallel. Alternating current power is received by primary winding 10 disposed on transformer core 12. Secondary winding 14 is disposed on core 12 and thereby magnetically coupled to primary winding 10. One end of winding 14 is connected to one end 19 of a winding 20 wrapped on core 16 of a current-limiting inductor having magnetic core 16 with a gap 18. The other end 21 of the winding 20 of the series-connected current-limiting inductor is connected to the central tap 22 of a winding pair on magnetic core 24. The central tap 22 is part of two windings 26 and 28 which are magnetically coupled by core 24. The ends 30 and 32 of windings 26 and 28, respectively, are connected to filaments 34 and 36 of lamps 38 and 40, respectively. One side of lamp filaments 42 and 44 are each connected to the other end of secondary winding 14, as shown. The current-limiting inductor limits the flow of current through the arc discharge of the lamps 38 and 40. This configuration requires an additional magnetic element 24 compared to a series connection, since the magnetic element 24 is needed to accommodate the difference in lamp voltage of the lamps in parallel. Further, this approach is limited to two lamps connected in parallel as described above.

Figure 2:
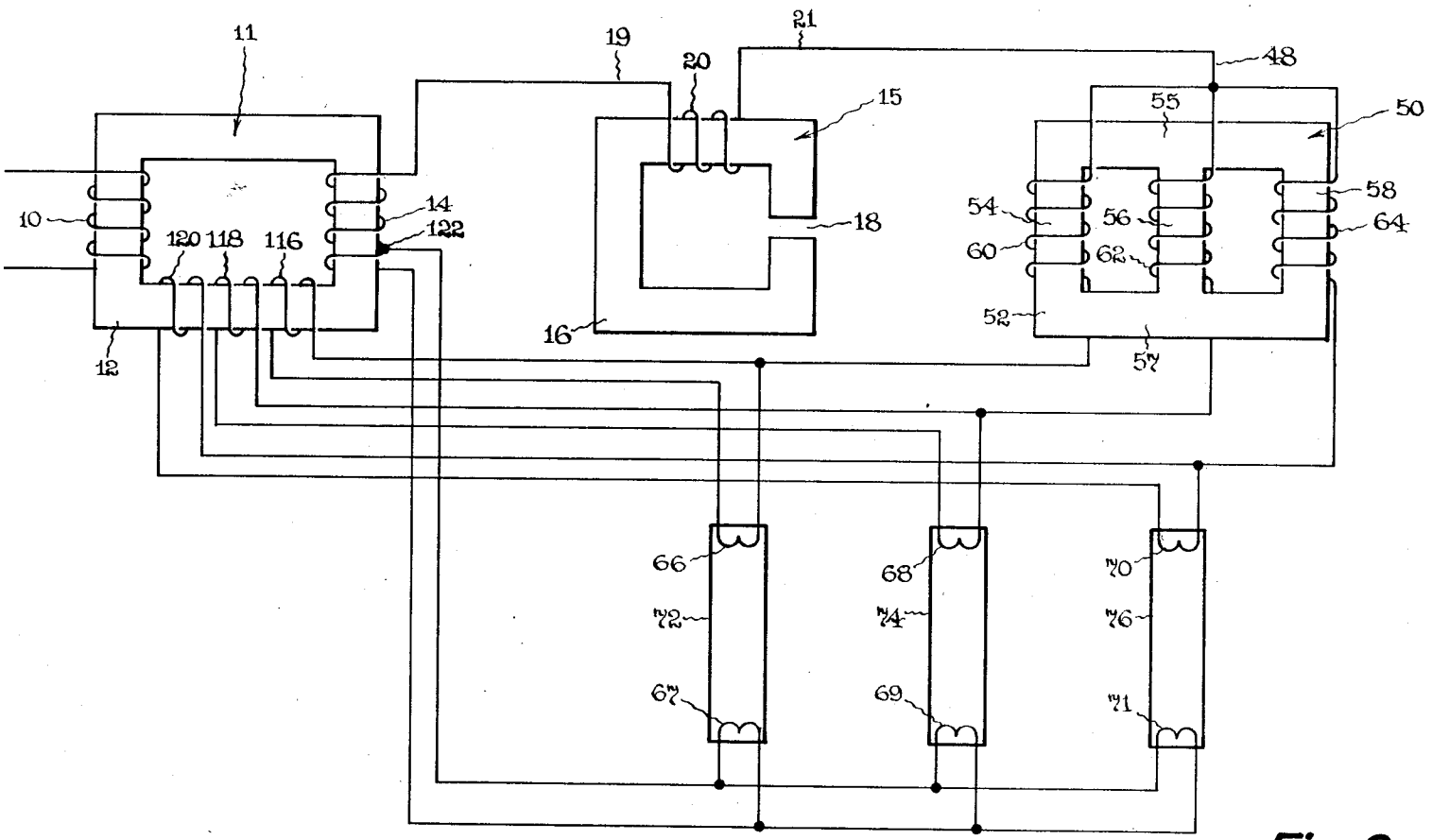
FIG. 2 is a schematic diagram of a lamp ballast circuit in accordance with the present invention for driving three parallel-connected gas discharge lamps.

The present invention provides a configuration of a ballast circuit for driving more than two lamps connected in parallel. FIG. 2 illustrates one embodiment of the present invention capable of paralleling more than two discharge lamps. In FIG. 2, the transformer 11 and current-limiting inductor 15 provide the same functions as those shown in FIG. 1 with the transformer and inductor having an approximately 50% greater volt-ampere rating to be able to supply the additional lamp power. Although the preferred embodiments describe an inductive ballast, a capacitive ballast or high frequency inverter could be employed as the power supply circuit. The current-balancing transformer must properly operate independently of ballast or impedance characteristics of the load. The end 21 of winding 20 is connected to an input 48 of a current-balancing transformer 50. The current-balancing transformer 50 comprises a core 52 having legs 54, 56 and 58 joined by top bar 55 and bottom bar 57, each having windings 60, 62 and 64, respectively, wound thereon. One end of each of windings 60, 62 and 64 is connected to the input 48 from winding 20, and the other end of each of the respective windings 60, 62 and 64 is connected to a respective filament 66, 68 and 70 of lamps 72, 74 and 76.

The present invention can be employed with a plurality of series-connected lamps in place of one or more of the lamps 72, 74 and 76, so long as the total sum of the effective lamp voltages, usually corresponding to lamp lengths, connected in series with each respective one of windings 60, 62 and 64 is substantially identical. Although the lamps are shown connected to the bottom end of windings 60, 62 and 64, different connections are usable. For example, lamps 72 and 74 could be equal voltage four-foot fluorescent lamps connected as shown and lamp 76 could be relocated as a four-foot lamp of voltage equal to lamps 72, 74 having filament 70 connected to input 48 at one end and filament 71 connected to the top end of winding 64. As the above examples illustrate, the present invention allows flexibility in selecting lamp length and connection arrangement, so long as each current-balancing winding is connected in series with a total lamp voltage substantially identical to the lamp voltage of the loads connected in series with each of the other current-balancing windings. Starting of the lamps may be assisted by providing isolated filament heating windings on core 12, as shown at 116, 118 and 120 connected respectively to filaments 66, 68 and 70, and by tapping winding 14 at 122 for heating filaments 67, 69 and 71, as shown in FIG. 2, or alternatively, by an external independent preheat current source connected to each of the windings.

Current-balancing transformer 50 does not exhibit the classical primary/secondary relationship. Each winding balances the others. For symmetrical operation, the cross-sectional areas of legs 54, 56, 58, top bar 55 and bottom bar 57 are equal and the coils 60, 62, 64 have identical numbers of turns of the same conductor. The winding on each leg is wound on the respective transformer core leg such that the resultant magnetic flux due to current flow in each winding is in the same direction relative to the top and bottom bars. For example, assume the currents in the coils 60, 62 and 64 are equal and the flux in each leg is flowing toward the top of the core. Since flux cannot be stored in a core, the summation of fluxes at the top of the core must equal zero. The only solution to this requirement is that the flux in each leg be zero. This requires the coil voltage in each of coils 60, 62 and 64 to be zero, and the current-balancing transformer 50 appears as a short circuit. Thus, the current-balancing transformer 50 imposes no volt-second or volt-amp losses to the circuit.

Now assume that the current in coil 60 is slightly larger than the current in coils 62 and 64 due to a lower voltage lamp being connected in series with coil 60. Since the total voltage of the series combination of coil 60 and lamp 72 must equal the total voltage of the series combination of coil 62 and lamp 74 and the total voltage of the series combination of coil 64 and lamp 76, a voltage is now forced across all the coils. Under these voltage/current conditions the sum of the fluxes of legs 54, 56 and 58 in the top of the core must still be zero, because the core cannot store flux. To satisfy this requirement when the system stabilizes, the voltage across coils 62 and 64 will be equal, one-half the magnitude of the voltage across coil 60 and of opposite polarity to the voltage across coil 60. Thus, for small changes in lamp voltages, the currents in the lamps are equal. From the calculation for three legs the worst case volt-sec imposed across any winding is proportional to $\frac{2}{3}$ times the worst case expected lamp voltage difference. Thus, the relative size of the current-balancing transformer 50 is only a small fraction of the size of transformer 11.

The first function of the current-balancing transformer is to force current sharing during normal lamp operation. Another function of the current-balancing transformer is to facilitate lamp starting. Once the first lamp starts, a substantial voltage is imposed across the coils associated with lamps that have not started, because at least one other coil is unloaded. This then imposes an opposite polarity voltage across the other coils which further aids starting of succeeding lamps, until all lamps are lit. For example, an unlit lamp 76 will experience an extremely large starting voltage from the unloaded winding 64 connected in series with it, because the opposite polarity voltage imposed upon the unloaded winding 64 will be added to the voltage across the operating lamps 72, 74 and the sum of the voltages across winding 64 and lamps 72, 74 will be imposed across the unlit lamp. The magnitude and time of occurrence of the voltage spike is determined by the core volt-second rating, the turns ratio of the windings and parasitics, such as intrawinding capacitance. Thus, this approach virtually assures that even a marginal lamp that requires higher than normal starting voltage will start using the current-balancing transformer approach described herein. Furthermore, the arrangement of the present invention will allow all unfailed lamps to operate at elevated levels if some lamps fail. This is due to the fact that the initial high voltage across the failed leg will quickly saturate that portion of the core. This effectively removes the leg of the failed lamp from the magnetic circuit. Thus the combination of coil and lamp of the unfailed lamps will always be balanced, and failure of one lamp will leave the other parallel-connected lamps unaffected due to current balancing.

Figure 3:
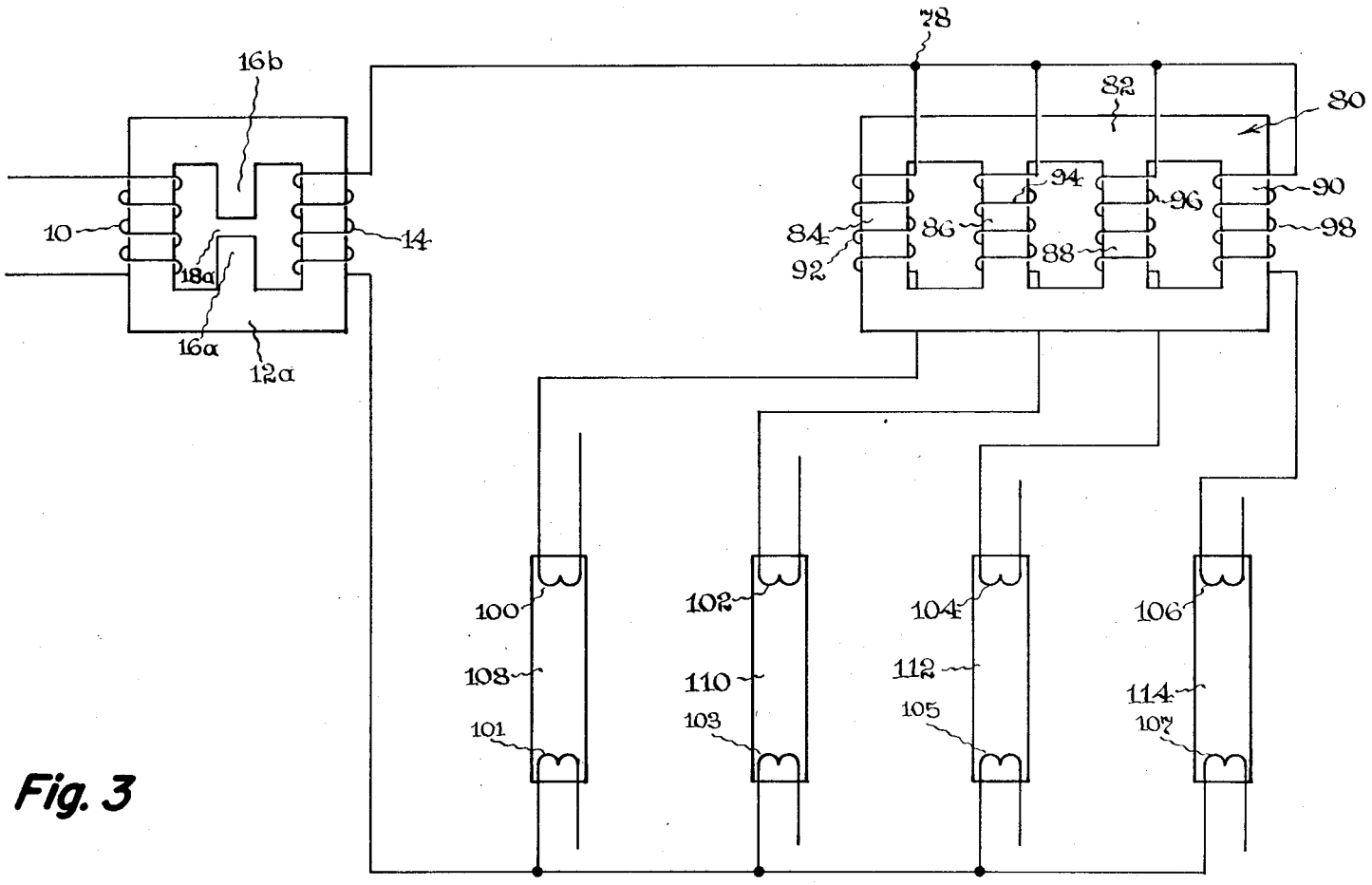
FIG. 3 is a schematic diagram of a lamp ballast circuit in accordance with the present invention for driving four parallel-connected gas discharge lamps.

In FIG. 3, an embodiment of the present invention for driving four parallel gas discharge lamps is illustrated. Alternating current power is supplied to the primary winding disposed on the transformer core 12*a*. In this embodiment, the current-limiting function is accomplished by incorporating the inductor into the transformer core 12*a* by the addition of arms 16*a* and 16*b* separated by gap 18*a*. Secondary winding 14 is connected to the current-balancing transformer 80. The current-balancing transformer 80 includes a core 82 including legs 84, 86, 88 and 90 having windings 92, 94, 96 and 98, respectively, wound thereon and connected at one end thereof to the secondary winding 14 and shown at 78. The opposite ends of windings 92, 94, 96 and 98 are connected to filaments 100, 102, 104 and 106 of lamps 108, 110, 112 and 114, respectively. This configuration eliminates the current-limiting inductor, and thereby further reduces the magnetic components in the ballast system. The filaments 101, 103, 105 and 107 are connected to the secondary winding 14. Preheating current may be supplied to the filaments as described above for FIG. 2. The system shown in FIG. 3 operates in a manner similar to the system shown in FIG. 2. When all of the lamps are operating in a balanced fashion, no flux flows in any part of the magnetic core 82. When the current in one of the coils is slightly larger due to a lower voltage lamp in series with that coil, magnetic flux will be generated in the corresponding leg of the core 82, and voltages will be forced across the remaining coils to create a balance in the sum of voltages across the coil and the respective gas discharge lamp.

From the above, it will be appreciated that the ballast circuits of the present invention provide a means for driving a plurality of gas discharge lamps in a parallel-connected configuration which is expandable to any number of lamps and requires fewer connections in the fixture than other ballast circuits. Furthermore, it should also be appreciated that the present invention provides the economy of employing a single ballast circuit with a single current-balancing transformer to drive multiple parallel-connected gas discharge lamps.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

What I claim as new and desire to secure by Letters Patent of the United States is:

1. A gas discharge lamp circuit comprising:
power supply means for supplying an a.c. voltage output;
impedance means for limiting the current level of said a.c. voltage output from said power supply means;
a plurality of at least three electrical load means connected electrically in parallel for receiving electrical power from said power supply means; and
current-balancing transformer means for providing current sharing among said plurality of electrical load means comprising:
magnetic core means having a plurality of magnetic core legs equal to the number of electrical load means and magnetic core top bars and bottom bars connecting said plurality of core legs;
a plurality of electrical windings each disposed upon a respective one of said core legs and connected electrically in series with a respective one of said electrical loads; said windings being wound upon said respective core legs such that magnetic flux induced in each of said respective core legs by current flowing through said respective windings to supply said respective loads tends to flow in the same direction relative to said top and bottom bars.

2. The invention of claim 1 wherein:
each of said magnetic core legs comprises a magnetic core of a substantially equal predetermined cross-sectional area.

3. The invention of claim 2 wherein:
each of said respective windings comprises an equal number of turns wound upon a respective one of said core legs.

4. The invention of claim 3 wherein said plurality of electrical load means comprises:
a plurality of electrical loads having a negative impedance characteristic over at least part of their normal operating range.

5. The invention of claim 3 wherein said plurality of electrical load means further comprises:
a plurality of electrical loads having a non-linear impedance characteristic over at least part of their normal operating range.

6. The invention of claim 3 wherein each of said electrical loads comprises:
at least one gas discharge lamp connected in electrical series with each respective one of said windings.

7. The invention of claim 6 wherein:
the effective total voltage of the electrical load connected in series with each of said respective windings is substantially equal.

8. The invention of claim 7 wherein each of said electrical loads comprises:
a fluorescent lamp having a predetermined length.

9. The invention of claim 8 wherein each of said electrical loads comprises:
a first fluorescent lamp having a length of approximately four feet connected to one side of a respective one of said windings; and
a second fluorescent lamp having a length of approximately four feet connected to the other end of said respective one of said windings.

10. The invention of claim 7 wherein:
a first one of said electrical loads comprises a fluorescent lamp having a length of approximately eight feet connected in electrical series with a first one of said windings; and each of the remaining ones of said electrical loads comprises:

a first fluorescent lamp having a length of approximately four feet connected to one side of a respective one of the remaining windings; and a second fluorescent lamp having a length of approximately four feet connected to the other side of said respective one of said remaining windings.

11. The invention of claim 3 wherein:

said magnetic core comprises three magnetic legs of substantially equal cross-sectional area joined together by top and bottom bars of magnetic material of cross-sectional area substantially equal to said cross-sectional area of said legs;

each of said respective windings comprises an equal number of turns of electrical conductor wound upon a respective one of said core legs; and said plurality of electrical loads comprises three fluorescent lamps of substantially equal length connected electrically in series with respective ones of said windings disposed upon respective ones of said legs.

12. The invention of claim 3 wherein:

said magnetic core comprises four magnetic legs of substantially equal cross-sectional area joined together by top and bottom bars of magnetic material of cross-sectional area substantially equal to said cross-sectional area of said legs;

each of said respective windings comprises an equal number of turns of electrical conductor wound upon a respective one of said core legs; and said plurality of electrical loads comprises four fluorescent lamps of substantially equal length connected electrically in series with respective ones of said windings disposed upon respective ones of said legs.

* * * * *